US006089406A

United States Patent [19]

Feldner

[11] Patent Number: 6,089,406

[45] Date of Patent: Jul. 18, 2000

[54] PACKAGED FOOD WARMER AND DISPENSER

[75] Inventor: Paul R. Feldner, Menomonee Falls, Wis.

[73] Assignee: Server Products, Menomonee Falls, Wis.

[21] Appl. No.: 09/323,189

[22] Filed: Jun. 1, 1999

[51] Int. Cl.[7] ..... B65D 35/22

[52] U.S. Cl. ..... 222/103; 222/94; 222/95; 222/105; 222/82; 222/83.5; 222/183; 222/146.5; 222/130

[58] Field of Search ..... 222/82–83.5, 94, 222/95, 103, 105, 130, 146.5, 183

[56] References Cited

U.S. PATENT DOCUMENTS

| | | | |
|---|---|---|---|
| 2,246,693 | 6/1941 | Ohme | 222/183 |
| 3,206,074 | 9/1965 | Hoffmann | 222/94 |
| 3,435,990 | 4/1969 | Pike, Jr. | 222/1 |
| 3,908,863 | 9/1975 | White | 222/103 |
| 4,586,635 | 5/1986 | Collins, Jr. | 222/94 |
| 4,603,793 | 8/1986 | Stern | 222/105 |
| 4,736,872 | 4/1988 | Ryder et al. | 222/94 |
| 5,085,346 | 2/1992 | Wright | 222/183 |
| 5,096,092 | 3/1992 | Devine | 222/95 |
| 5,100,025 | 3/1992 | McGraw | 222/95 |
| 5,100,026 | 3/1992 | Farrell | 222/95 |
| 5,102,015 | 4/1992 | Barnard et al. | 222/135 |
| 5,186,359 | 2/1993 | Brown et al. | 222/94 |
| 5,301,601 | 4/1994 | Cretors | 222/105 |
| 5,433,345 | 7/1995 | Sasaki et al. | 222/81 |
| 5,435,463 | 7/1995 | Hodgson | 222/105 |
| 5,452,826 | 9/1995 | Stern | 222/207 |
| 5,613,622 | 3/1997 | Surrena et al. | 222/105 |

*Primary Examiner*—J. Casimer Jacyna
*Attorney, Agent, or Firm*—Andrus, Sceales, Starke & Sawall

[57] ABSTRACT

A packaged food warmer and dispenser that includes an open interior sized to receive a pair of collapsible containers including food product. A paddle assembly including a movable paddle member is positioned within the open interior to divide the open interior into a storage area and a dispensing area. A collapsible container of food product is received in both the dispensing area and storage area. The collapsible bag of food product in the dispensing area is connected to a pump assembly and dispensed from the food product warmer and dispenser. The collapsible container of food product in the storage area exerts a bias force on the pivotable pressure paddle to urge the food product from the collapsible container in the dispensing section. The pressure paddle includes a heating element positioned between a front face surface and a back face surface to heat each of the collapsible containers. In addition, a heating element is positioned in contact with each wall defining the storage area to further heat the food product contained in the collapsible containers.

23 Claims, 7 Drawing Sheets

PACKAGED FOOD WARMER AND DISPENSER

BACKGROUND OF THE INVENTION

The present invention generally relates to a food warmer and dispenser for dispensing liquid foods, such as syrups, fudges for ice cream, condiments, sandwich toppings, dairy products, and other types of liquid food products. More specifically, the present invention relates to a food warmer and dispenser that can be used to dispense liquid food products from collapsible containers, such as vacuum sealed plastic bags.

Currently available liquid food product dispensers typically include an open interior that receives a supply of the food product. The food product, such as nacho cheese, syrups and toppings for ice cream, is poured from a storage container, such as a can, into the open interior where the liquid food product is heated and dispensed through a pump assembly. While this type of liquid food warmer and dispenser has proven effective in heating and dispensing liquid food product, cleaning the food product from the inner walls of such a dispenser has proven both difficult and time-consuming.

In response to this problem, liquid food product is currently available in sealed, collapsible containers that include a fitting designed to receive a pump assembly. An example of this type of collapsible container and fitting is shown in U.S. Pat. No. 4,603,793, incorporated herein by reference. The fitting formed in the collapsible container of food product is positioned near one end of the container such that the force of gravity causes the food product to collect near the fitting when the container is positioned in the dispenser. Although this type of warmer and dispenser functions well to dispense the liquid food product, a significant amount of food product in the container below the fitting is unrecoverable and thus wasted.

In addition to the problem of unrecovered food product from each collapsible container, currently available liquid food warmers and dispensers hold only a single container of food product at a time. Thus, when the collapsible container of food product currently in the dispenser is emptied, the container must be replaced by a full container of food product. However, replacement containers are typically stored at room temperature and must be preheated within the warmer prior to dispensing. This is a serious drawback when utilizing the food warmer and dispenser in a high volume applications.

Therefore, it is an object of the present invention to provide a combined food product warmer and dispenser that can remove a high percentage of the food product contained within a collapsible container. It is an additional object of the invention to provide a food product warmer and dispenser that includes an open interior including a storage area and a dispensing area that can each simultaneously receive a container of food product. Further, it is an object of the invention to provide a food warmer configured to allow a collapsible container of food product in the dispensing area to be dispensed while a second collapsible container of food product in the storage area can simultaneously be preheated to the operating temperature.

It is a further object of the invention to utilize the stored collapsible container of food product to exert a force on the collapsible container of food product currently being dispensed to aid in extracting the food product contained within the collapsible container. Still further, it is an object of the present invention to provide a movable pressure paddle in the open interior of the dispenser to divide the open interior into the storage area and the dispensing area. It is an additional object of the present invention to provide an opening in the pressure paddle such that the fitting contained within the collapsible container of food product can pass through the opening such that the pressure paddle can move into contact with the front wall of the open interior.

SUMMARY OF THE INVENTION

The present invention is a combination food product warmer and dispenser for dispensing liquid food product contained within a collapsible container, such as a vacuum-sealed plastic bag. The food product warmer and dispenser include a storage enclosure having a front wall, a back wall and a pair of opposed sidewalls. The walls of the storage enclosure define an open interior that is large enough to receive at least two collapsible containers of food product.

A pressure paddle is pivotally mounted within the open interior and divides the open interior into a dispensing area and a storage area. The dispensing area is formed between the front wall of the storage enclosure and the front face of the pressure paddle, while the storage area is formed between the rear face of the pressure paddle and the back wall of the storage enclosure. The size of both the dispensing area and the storage area vary as the pressure paddle moves within the open interior.

In the preferred embodiment of the invention, the pressure paddle includes a heating element positioned between a front paddle face member and a rear paddle face member. The heating element is connected to a supply of electricity and generates heat that is transferred to the collapsible containers through each of the paddle face members. The pressure paddle includes an upper section and a lower section that are joined to each other at an angle. The angle between the upper and lower sections of the pressure paddle is such that the lower section of the pressure paddle is generally parallel to the front wall of the storage enclosure when the pressure paddle is pivoted completely forward toward the front wall of the storage enclosure.

The pressure paddle includes an opening that extends completely through the pressure paddle. The opening is positioned such that a portion of the opening is contained in the lower section of the pressure paddle and the remainder of the opening is contained in the upper portion of the pressure paddle. When the pressure paddle rotates toward the front wall of the storage enclosure, a fitting contained within the collapsible container positioned in the dispensing area can pass through the opening in the pressure paddle.

The food warmer and dispenser includes a heating element positioned in contact with the outer face of each wall that defines the storage enclosure. Each of the heating elements generates heat that is transferred from the individual heating elements to the open interior of the storage enclosure. When collapsible containers of food product are contained within both the dispensing area and storage area of the open interior, the heat generated by each heating element is transferred to the food product contained within the collapsible containers. Since the packaged food warmer and dispenser of the present invention permits at least two collapsible containers of food product to be simultaneously stored, the heat generated by each of the heating elements heats not only the collapsible container being dispensed, but also the food product contained in the collapsible container being stored.

As the food product is being dispensed from the collapsible container contained in the dispensing area, the full collapsible container in the storage area exerts a bias force on the pressure paddle to press the pressure paddle into contact with the collapsible container contained in the dispensing area. As food product continues to be dispensed from the collapsible container in the dispensing area, the bias force exerted by the collapsible container in the storage area forces food product toward the fitting and out of the pump assembly. In this manner, the bias force exerted by the collapsible container contained in the storage area functions to increase the amount of food product that is recoverable from each collapsible container.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE DRAWINGS

Figure 1:
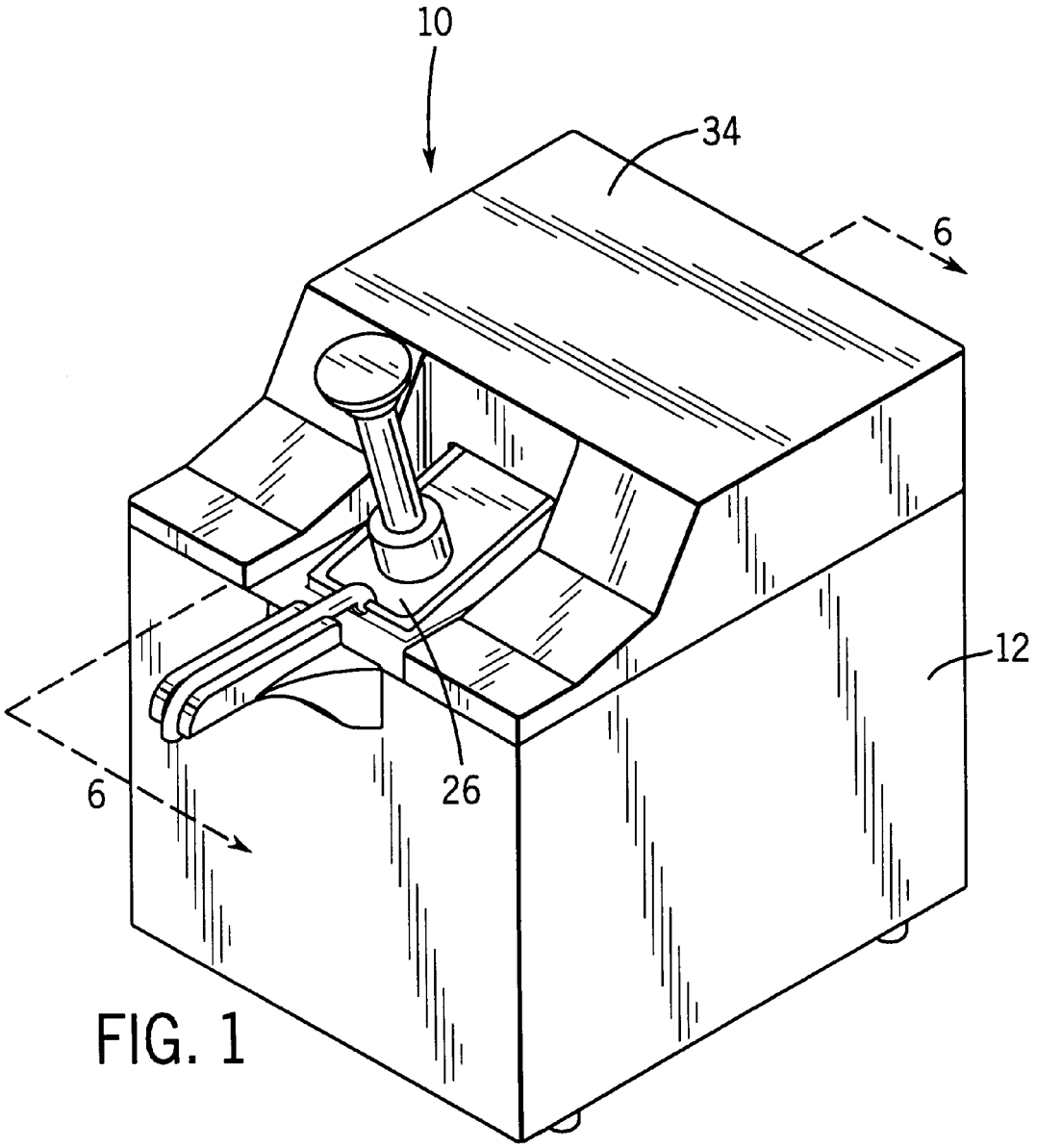
FIG. 1 is a perspective view illustrating a food product warmer and dispenser of the present invention.
Figure 2:
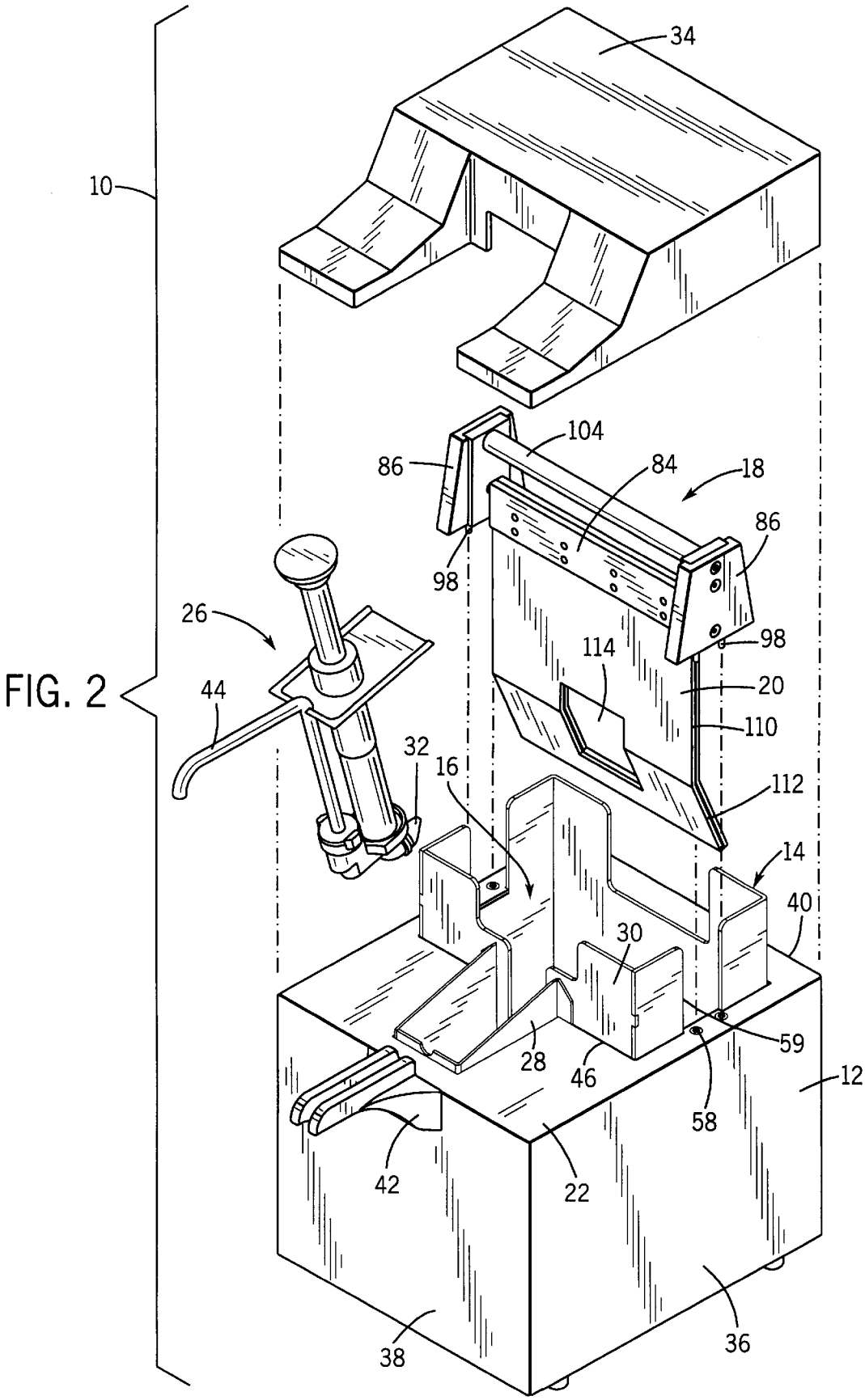
FIG. 2 is an exploded perspective view illustrating the positioning of a paddle assembly within an open interior of the food product warmer and dispenser.

A food warmer and dispenser 10 of the present invention is best shown in FIGS. 1 and 2. The food warmer and dispenser 10 can be used to heat and dispense a liquid food product, such as syrups, fudges for ice cream, cheese products and other similar types of liquid foods. Preferably, the food warmer and dispenser 10 of the present invention heats and dispenses liquid food product that is contained within a collapsible container, such as vacuum sealed plastic bags.

Figure 3:
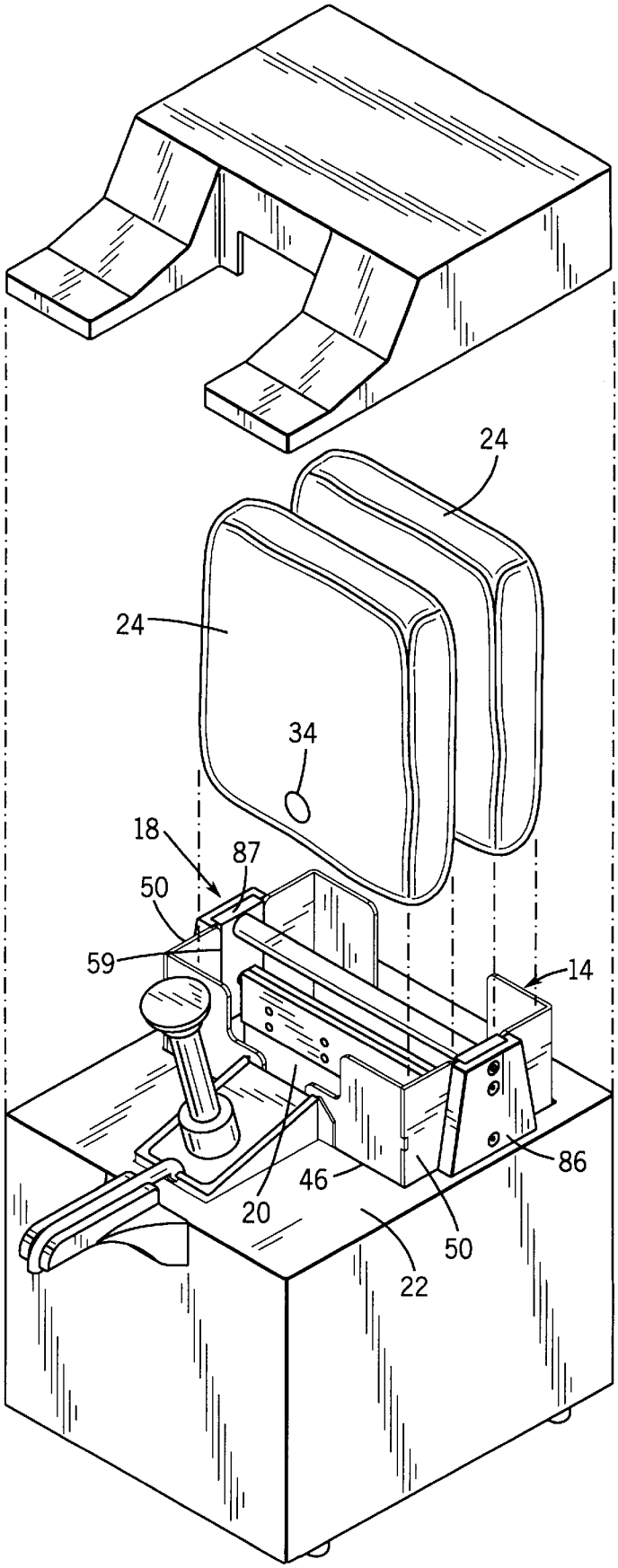
FIG. 3 is an exploded perspective view illustrating the positioning of a pair of food product containers within the storage area and dispensing area formed in the open interior of the food product warmer and dispenser.

The food warmer and dispenser 10 generally includes a base member 12 that receives a storage enclosure 14 that defines a generally open interior 16. The open interior 16 of the storage enclosure 14 receives a paddle assembly 18 including a movable pressure paddle 20. The paddle assembly 18 is supported on an upper face surface 22 of the base member 12 such that the pressure paddle 20 extends downwardly into the open interior 16. As can be seen in FIG. 3, a pair of collapsible containers 24 of food product can be positioned within the open interior 16 defined by the storage enclosure 14. Specifically, one of the collapsible containers 24 is received on each side of the pressure paddle 20 positioned within the open interior 16, as will be discussed in greater detail below.

The food warmer and dispenser 10 further includes a pump assembly 26 that is received within a pump enclosure 28 extending from a front wall 30 of the storage enclosure 14. The pump assembly 26 includes a piercing connector 32 that is received within a fitting 34 (FIG. 3) contained in the collapsible container 24. The interaction between the piercing connector 32 and the fitting 34 allows the pump assembly 26 to extract food product from within the collapsible container 24.

A cover member 34 is received on the base member 12 to cover the open interior 16 and give the food warmer and dispenser 10 a clean and appealing outer surface. The profile of the cover member 34 is selected to allow the pump assembly 26 to be operated when the cover member 34 is installed on the base member 12.

As can be seen in FIG. 2, the base member 12 is generally rectangular and defined by spaced sidewalls 36, a front wall 38 and a back wall 40. In the preferred embodiment of the invention, the sidewalls 36, front wall 38, back wall 40 and upper face surface 22 are formed from a durable metallic material, such as stainless steel, that allows the base member 12 to be quickly and easily cleaned after use. A spout support 42 is mounted to the front wall 38 of the base member 12 to support a spout 44 of the pump assembly 26. In the preferred embodiment of the invention, the spout support 42 is heated to keep the liquid food product hot during the dispensing cycle.

The base member 12 is generally hollow and receives the storage enclosure 14 in an opening 46 formed in the upper face surface 22. The storage enclosure 14, best shown in FIG. 5, includes the front wall 30, a back wall 48 and a pair of opposed sidewalls 50. The combination of the front wall 30, back wall 48 and sidewalls 50 define the generally rectangular open interior 16 that receives the collapsible containers of food product 24.

Figure 6:
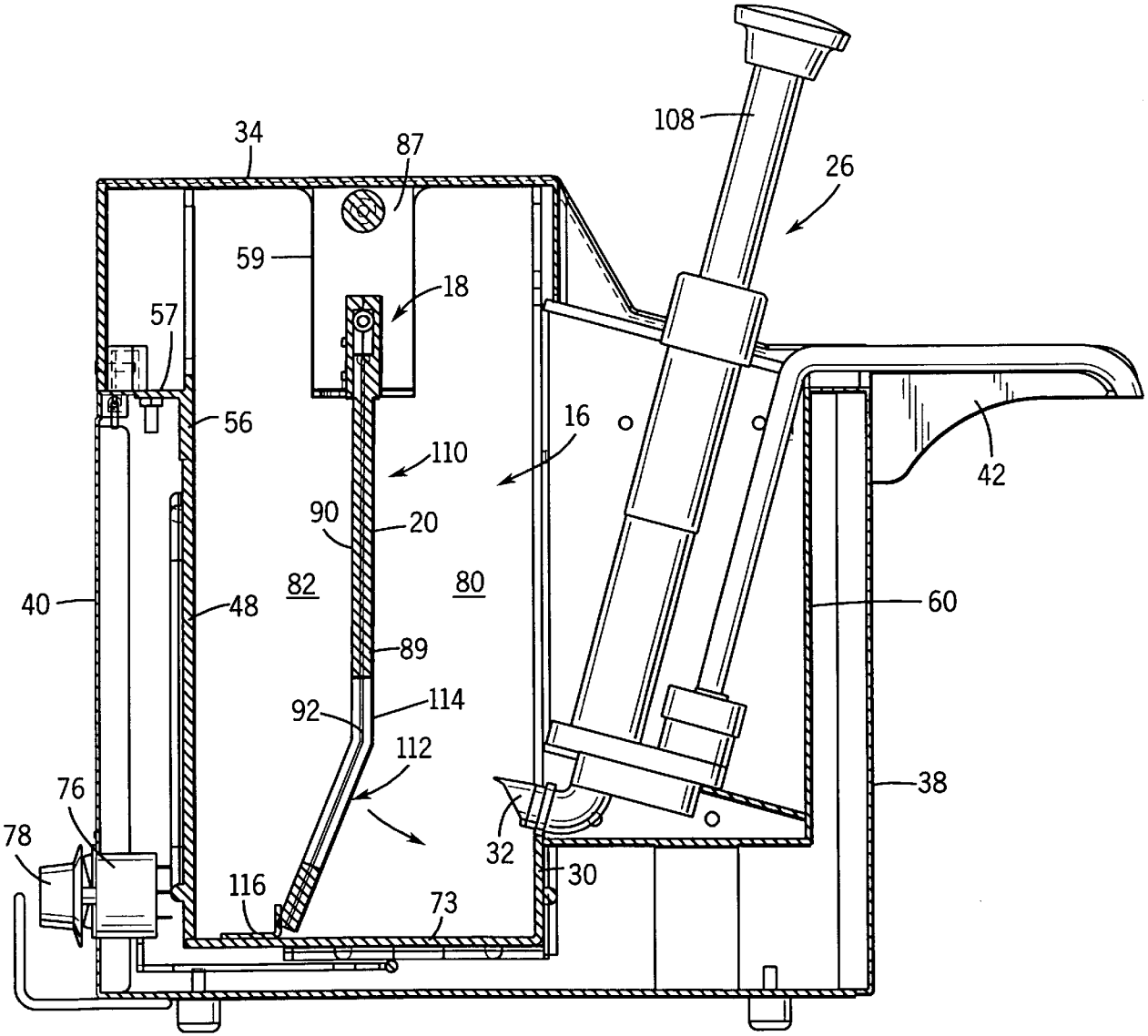
FIG. 6 is a partial section view taken along line 6—6 of FIG. 1.

Each of the sidewalls 50 includes a support member 52 having a horizontal support flange 54, while the back wall 48 includes a similar support member 56 having a horizontal support flange 57 (FIG. 6). The support member 52 on each sidewall 50 and the support member 56 on the back wall 48 contact the underside of the upper face surface 22 of the base member 12 to prevent the storage enclosure 14 from being pulled upward through the opening 46 formed in the upper face surface 22 of the base member 12.

The horizontal support flanges 54 each include a pair of spaced electrical receptacles 58 that are aligned with corresponding openings formed in the upper face surface 22 of the base member 12. The electrical receptacles 58 are connected to a supply of electricity within the base member 12 (not shown) for reasons that will be discussed in detail below. As can be seen in FIG. 1, each of the electrical receptacles 58 are accessible through aligned openings formed in the upper face surface 22 of the base member 12.

Figure 5:
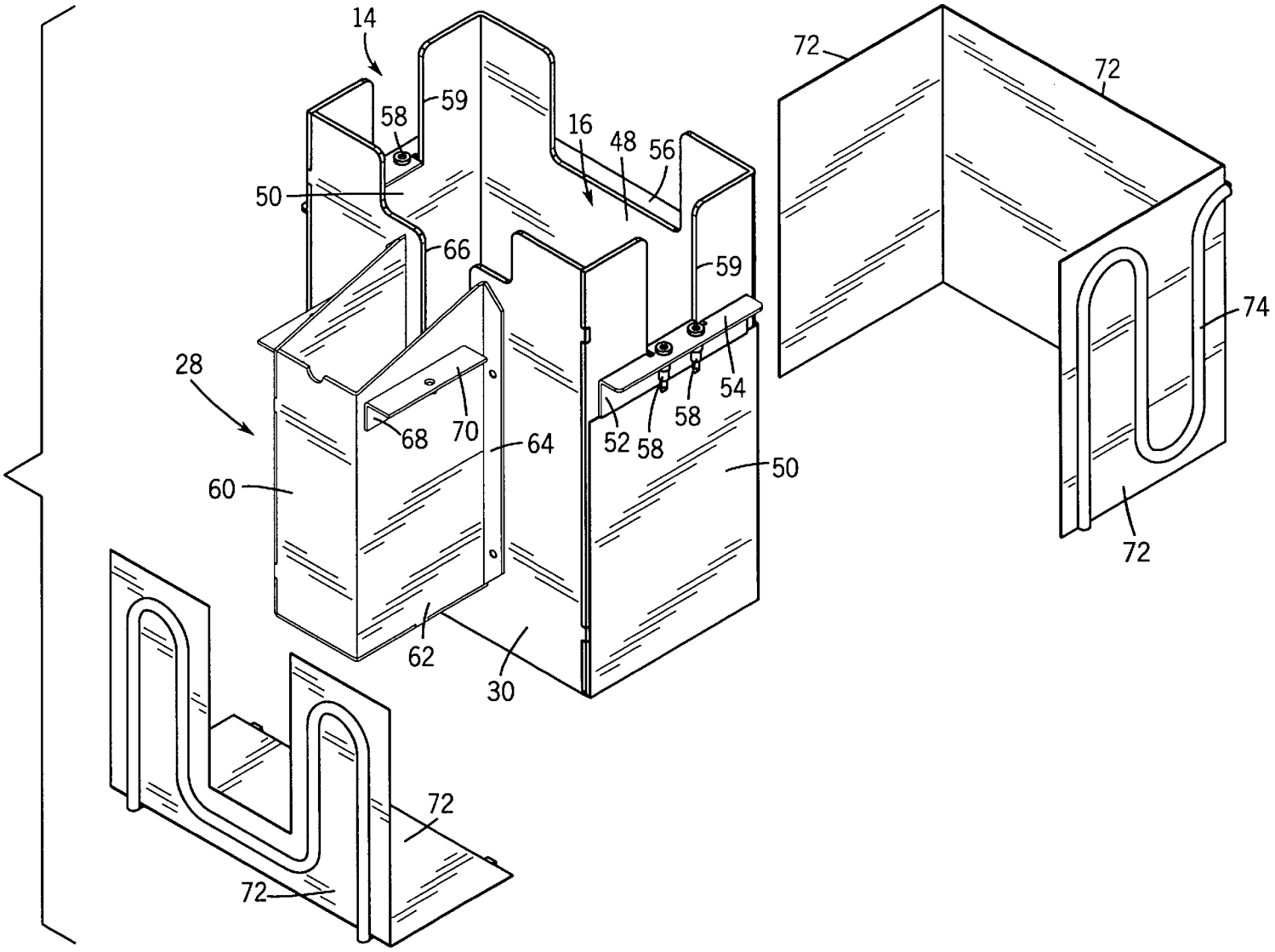
FIG. 5 is an exploded perspective view of a storage enclosure defining the open interior and a series of heating elements positioned adjacent thereto.

As shown in FIG. 5, the sidewalls 50 each include a paddle opening 59 that extends from the top edge of the sidewall 50 to the horizontal support flange 54 formed on the support member 52. The paddle opening 59 has a width of approximately one-third the overall width of sidewall 50.

The pump enclosure 28 is separately formed and secured to the front wall 30 of the storage enclosure 14. Specifically, the pump enclosure 28 includes a front wall 60 and a pair of opposed sidewalls 62. Each of the sidewalls 62 includes a perpendicular attachment flange 64 that provides a point of attachment between the pump enclosure and the front face of the front wall 30. The front wall 30 includes an access opening 66 extending downward from the upper edge of the front wall 30. The access opening 66 allows the piercing connector 32 contained on the pump assembly 26 to pass through the front wall 30 into the open interior 16, as shown in FIG. 6. Referring back to FIG. 5, each of the sidewalls 62 of the pump enclosure 28 include a support member 68 having a horizontal support flange 70 that contacts the inner surface of the upper face 22 of the base member 12 (FIG. 3) to retain the pump enclosure 28 within the base member 12.

A series of individual heating elements 72 are positioned to surround the outer walls of the storage enclosure 14. Specifically, an individual heating element 72 is positioned in contact with the front wall 30, the back wall 48, each of the sidewalls 50 and the bottom wall 73. Each of the heating elements 72 is a plate-like member having a heating tube extending in a tortuous path along the surface of the plate member. In the preferred embodiment of the invention, each of the heating elements 72 is electrically operated. The heating elements 72 are connected to a supply of electric power through a thermostat 76 that has a temperature control dial 78 extending from the back wall 40 of the base member 12, as shown in FIG. 6. The temperature control dial 78 allows the user to adjust the temperature of the heating elements 72 positioned in contact with the walls of the storage enclosure 14.

As can be understood in FIG. 5, the combination of the heating elements 72 completely surround the outer walls of the storage enclosure 14 such that the heat generated by each of the heating elements 72 is transferred through the walls of the storage enclosure 14 and into the open interior 16. Specifically, heat is transferred from each of the heating elements 72 into the liquid food product contained in the collapsible containers 24 positioned within the open interior 16.

Although the preferred embodiment of the present invention is shown having separate, individual heating elements 72 positioned in contact with the walls of the storage enclosure 14, it is contemplated by the inventor that the heating elements could be cast into the walls of the storage enclosure 14 while operating within the scope of the invention.

Figure 4:
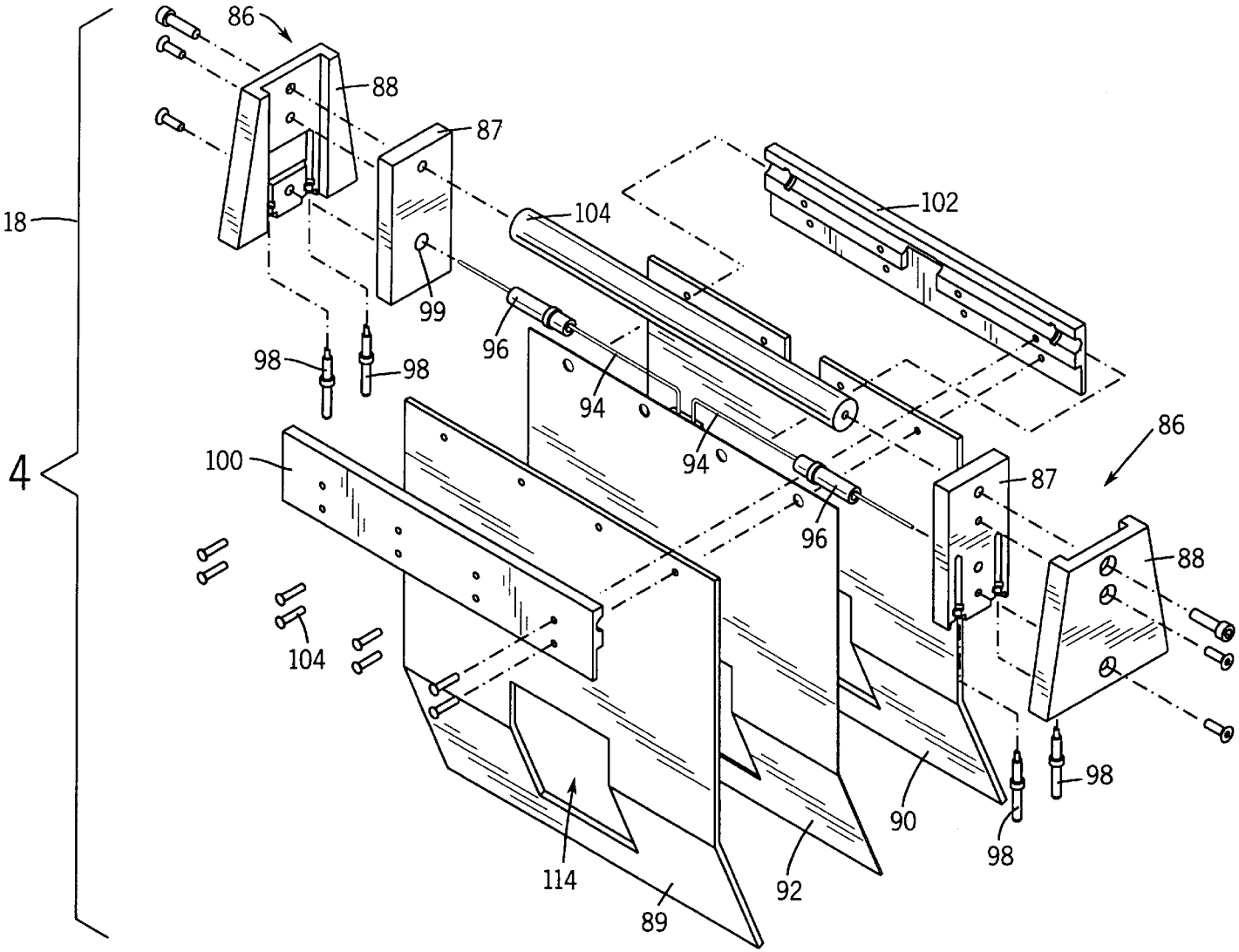
FIG. 4 is an exploded perspective view illustrating the construction of the paddle assembly.

FIGS. 2–4 illustrate the paddle assembly 18 of the present invention in its operative position and in an exploded view illustrating the specific components that form the paddle assembly 18. Referring first to FIG. 3, the paddle assembly 18 is operatively mounted to the upper face surface 22 of the base member 12 within the aligned paddle openings 59 formed in the opposed sidewalls 50 of the storage enclosure 14.

Figure 7:
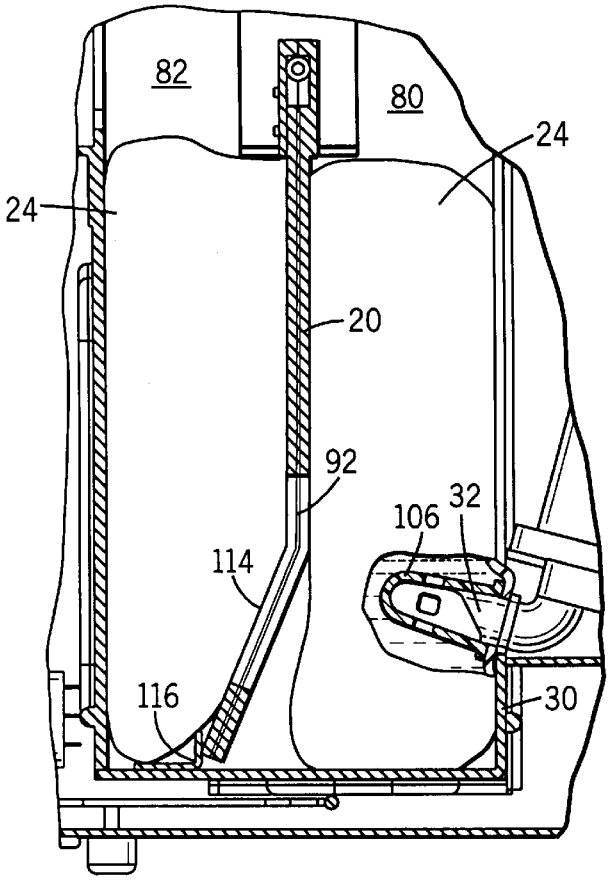
FIG. 7 is a partial section view illustrating the positioning of the pair of food product containers on each side of the pressure paddle within the open interior.

Referring now to FIG. 6, the paddle assembly 18 includes the pressure paddle 20 that extends downward into the open interior 16 of the storage enclosure 14. Pressure paddle 20 divides the open interior 16 into a dispensing area 80 and a storage area 82. The dispensing area 80 is generally defined by the area of the open interior 16 between the pressure paddle 20 and the front wall 30 of the storage enclosure 14. The storage area 82 is generally defined as the area of the open interior 16 between the pressure paddle 20 and the back wall 48 of the storage enclosure 14. As can be seen in FIGS. 3 and 7, both the dispensing area 80 and the storage area 82 can simultaneously receive a collapsible container 24 full of food product.

Upper end 84 of the pressure paddle 20 is pivotally mounted between a pair of side supports 86 generally defined by an inner guide block 87 and an outer retaining bracket 88. As can be seen in FIGS. 3 and 6, the inner guide block 87 has a width generally corresponding to the width of the paddle opening 59 formed in each of the sidewalls 50. The outer retaining bracket 88 is sized larger than both the inner guide block 87 and the paddle opening 59 to prevent lateral movement of paddle assembly 18 between the pair of opposed sidewalls 50.

Referring now to FIG. 4, the pressure paddle 20 is formed from a plurality of adjacent layers including a front paddle face member 89, a rear paddle face member 90 and a heating element 92 positioned between the front paddle face member 89 and the rear paddle face member 90. Both the front paddle face member 89 and the rear paddle face member 90 are formed from a thermally-conductive material, such as aluminum, that allows heat generated by the heating element 92 to pass through the respective face member and into the collapsible container 24 positioned in contact with the pressure paddle 20.

In the preferred embodiment of the invention, the heating element 92 is a resistance wire heating element positioned between two sheets of silicon and connected to a source of electricity by a pair of lead wires 94. Each of the lead wires 94 passes through a pivot member 96 and terminates with a pair of plugs 98. Plugs 98 are entrapped between the inner guide block 87 and outer retaining bracket 88 of each side support 86 and extend vertically below the respective side support 86. The plugs 98 are received within the receptacles 58 extending through the upper face surface 22 of the base member 12 to provide electricity to the heating element 92. The supply of electricity to the heating element 92 is also controlled by the thermostat 76.

The pivot members 96 are each pivotally received within a bore 99 formed in the inner face of the inner guide block 87 of the respective side support 86 and are each entrapped between a front support bracket 100 and a rear support bracket 102 contained on the upper end 84 of the pressure paddle 20. The front and rear support brackets 100, 102 are joined by a series of connectors 104 that pass through the front support bracket 100, the front paddle face member 89, the rear paddle face member 90, the heating element 92 and the rear support bracket 102. The mounting interaction between each of the pivot members 96 and the side supports 86 allows the pressure paddle 20 to pivot about the side supports 86 when the side supports 86 are fixed to the upper face surface 22 of the base member 12. A handle 104 is mounted between the spaced side supports 86 allows the paddle assembly 18 to be grasped and removed from within the open interior 16 when desired.

Referring now to FIG. 6, the pump assembly 26 is shown mounted within the pump enclosure 28. The pump assembly 26 shown in FIG. 6 functions in an identical manner to the pump assembly shown in U.S. Pat. No. 5,375,746, commonly owned by the assignee of the present invention and incorporated herein by reference. The pump assembly 26 includes the piercing connector 32 that pierces the collapsible container 24 and forms a seal with a fitting 106 contained within the collapsible container 24, as shown in FIG. 7. In the preferred embodiment of the invention, the collapsible container 24 is a vacuum-sealed plastic bag filled with liquid food product and contains a fitting similar to that shown in U.S. Pat. No. 4,603,793, incorporated herein by reference. In general, the pump assembly 26 includes a pump handle 108 that can be operated in a conventional manner to extract the liquid food product contained within the collapsible container 24 positioned within the dispensing area 80 of the open interior 16.

Referring now to FIGS. 2 and 6, the pressure paddle 20 includes an upper section 110 and a lower section 112 joined to each other at an angle. The angle between the upper section 110 and the lower section 112 is selected such that when the pressure paddle 20 rotates completely toward the front wall 30 of the storage enclosure 14, the lower section 112 is generally parallel to the front wall 30, as best understood in FIG. 8. The generally parallel arrangement between the lower section 112 of pressure paddle 20 and the front wall 30 of the storage enclosure 14 allows the pressure paddle 20 to press a high percentage of the total food product contained in the collapsible container 24 toward the fitting 106, as will be discussed in greater detail below.

Figure 8:
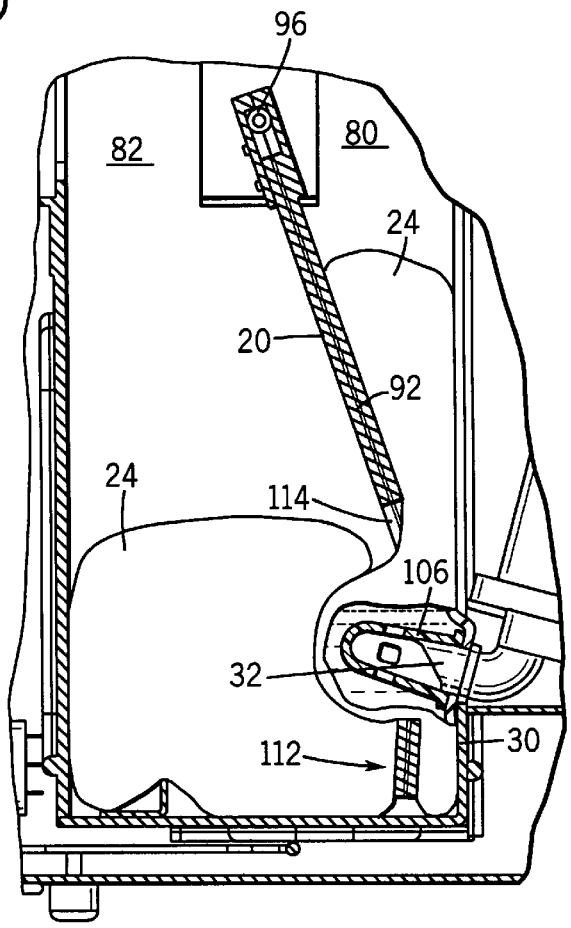
FIG. 8 is a partial section view illustrating the movement of the pressure paddle as food product is dispensed from the product container positioned within the dispensing area of the open interior.

The pressure paddle 20 includes an opening 114 that extends through the front paddle face member 89, the rear paddle face member 90 and the heating element 92 positioned therebetween. The opening 114 is generally centered laterally with respect to the width of the pressure paddle 20 and is formed in a portion of both the upper section 110 and the lower section 112. The opening 114 allows the fitting 106 contained in the collapsible container 24 to pass through the pressure paddle 20 as the pressure paddle 20 rotates toward the front wall 30 of the storage enclosure 14, as shown in FIG. 8. In this manner, the opening 114 allows a substantially greater amount of the food product contained within the collapsible container 24 to be pressed toward the fitting 106 and extracted by the pump assembly 26.

Referring now to FIGS. 7 and 8 in particular, the operation of the food warmer and dispenser 10 of the present invention will now be discussed. Initially, the paddle assembly 18 is inserted into the open interior 16 of the storage enclosure 14, as shown in FIG. 2. As the pressure paddle 20 of the paddle assembly 18 is lowered into the open interior 16, the guide block 87 of each side support 86 is received in the paddle opening 59 and the plugs 98 extending from the side supports 86 are received within the mating receptacle 58 extending through the upper face surface 22 of the base member 12.

Once the paddle assembly 18 is mounted between the sidewalls 50 of the storage enclosure 14 and supported by the base member 12, the piercing connector 32 of the pump assembly 26 is pressed into the fitting 106 and punctures the outer wall of one of the collapsible containers 24.

After the piercing connector 32 of the pump assembly 26 has been inserted into the fitting 106 of the collapsible container 24, both the collapsible container 24 and pump assembly 26 are lowered into the storage enclosure 14. Specifically, the pump assembly 26 is lowered into the pump enclosure 28, while the collapsible container 24 is inserted into the dispensing area 80 of the open interior 16. As the collapsible container 24 is inserted into the dispensing area 80, the size of the collapsible container 24 causes the pressure paddle 20 to rotate away from the front wall 30 of the storage enclosure 14. A stop member 116 limits the rotation of the pressure paddle 20 away from the front wall 30 of the storage enclosure 14, as shown in FIGS. 6 and 7.

Once the collapsible container 24 and pump assembly 26 have been inserted into the dispensing area 80 and pump enclosure 28, respectively, a second collapsible container 24 can be inserted into the storage area 82. As shown in FIG. 7, the pressure paddle 20 divides the open interior 16 into both the dispensing area 80 and storage area 82, each of which are large enough to receive a collapsible container 24. When both of the collapsible containers 24 are full of food product, the pressure paddle 20 is generally positioned in the middle of the open interior 16 such that the dispensing area 80 and the storage area 82 are of generally equal size.

After the pair of collapsible containers 24 are positioned within the open interior 16, the heating elements 72 positioned in contact with each wall of the storage enclosure 14 can be turned on. The heat generated by the heating elements 72 is transferred through the walls of the storage enclosure 14 and into the collapsible containers 24 containing food product. In addition, the heating element 92 contained within the pressure paddle 20 is also operated to provide heat to each collapsible container 24 through the face surfaces of the pressure paddle 20. As can be understood, an important advantage of the present invention is the ability to heat not only the food product in the collapsible container 24 within the dispensing area 80, but to also heat the food product in the collapsible container 24 in the storage area 82. After the food product has been completely dispensed from the collapsible container 24 in the dispensing area 80, the collapsible container 24 from the storage area 82 can be transferred to the dispensing area 80 and immediately dispensed without being preheated.

Referring now to FIG. 8, as the food product contained in the collapsible container 24 positioned in the dispensing area 80 is discharged by the pump assembly 26, the weight of the full product container 24 contained in the storage area 82 causes the pressure paddle 20 to pivot toward the front wall 30. As the pressure paddle 20 pivots, the weight of the product container 24 in the storage area 82 presses the pressure paddle 20 into the collapsible container 24 in the dispensing area 80 and forces the food product toward the fitting 106. As the pressure paddle 20 continues to rotate toward the front wall 30, the fitting 106 passes through the opening 114, which allows the pressure paddle to continue to rotate toward the front wall 30 until the lower section 112 contacts the front wall 30. Thus, the collapsible container 24 full of food product and positioned in the storage area 82 exerts a pressure force on the pressure paddle 20 to positively urge the food product in the dispensing area 80 toward the fitting 106, where it can be extracted by the pump assembly 26.

As can be understood in the Figures, the movable pressure paddle 20 divides the open interior 16 into both the dispensing area 80 and the storage area 82. The size of both the dispensing area 80 and the storage area 82 changes as the food product is removed from the collapsible container 24 contained within the dispensing area 80. In this manner, the movement of the pressure paddle 20 presses the food product toward the pump assembly 26 and changes the size of both the dispensing area 80 and the storage area 82 as food product is dispensed.

Various alternatives and embodiments are contemplated as being within the scope of the following claims particularly pointing out and distinctly claiming the subject matter regarded as the invention.

I claim:

1. A device for dispensing food product contained within a collapsible container, comprising:

a storage enclosure having an open interior sized to receive at least two collapsible containers of food product;

a movable pressure paddle positioned to divide the open interior of the storage enclosure into a dispensing area and a storage area, both the dispensing area and the storage area receiving at least one of the collapsible containers of food product; and a pump assembly operatively positioned to dispense food product from the collapsible container positioned in the dispensing area of the storage enclosure;

wherein the collapsible container of food product contained in the storage area presses the pressure paddle into contact with the collapsible container of food product in the dispensing area to urge the food product contained therein toward the pump assembly.

2. The device of claim 1 wherein the storage enclosure includes a pair of opposed sidewalls, a front wall and a back wall that are each joined to define the open interior, the storage area being at least partially defined by the pressure paddle and the back wall, and the dispensing area being at least partially defined by the pressure paddle and the front wall.

3. The device of claim 2 wherein the pressure paddle is pivotally mounted between the pair of opposed sidewalls and is movable toward the front wall.

4. The device of claim 1 wherein the pressure paddle extends between an upper end and a lower end and includes an opening formed between the upper end and the lower end such that the opening in the pressure paddle permits a fitting contained in the collapsible container of food product positioned in the dispensing area to pass through the pressure paddle as the food product is dispensed.

5. The device of claim 4 wherein the pressure paddle includes an upper section and a lower section, the lower section extending from the upper section at an angle wherein the lower section of the pressure paddle is generally parallel to a front wall of the storage enclosure when the pressure paddle is pivoted toward the front wall of the storage enclosure.

6. The device of claim 5 wherein the opening formed in the pressure paddle is formed in both the upper section and the lower section of the pressure paddle.

7. A device for dispensing food product contained within a collapsible container, comprising:

a storage enclosure having an open interior sized to receive at least two collapsible containers of food product;

a movable pressure paddle positioned to divide the open interior of the storage enclosure into a dispensing area and a storage area, both the dispensing area and the storage area receiving at least one collapsible container of food product, the pressure paddle including a heating element to heat the collapsible containers of food product positioned in contact therewith; and a pump assembly operatively positioned to dispense food product from the collapsible container of food product positioned in the dispensing area of the storage enclosure;

wherein the collapsible container of food product in the storage area presses the pressure paddle into contact with the collapsible container of food product in the dispensing area to urge the food product contained therein toward the pump assembly.

8. The device of claim 7 wherein the pressure paddle includes a front paddle face member, a rear paddle face member and the heating element positioned therebetween, the heating element being operable to generate heat that is transferred through the front paddle face member to the collapsible container of food product positioned in the dispensing area of the storage enclosure and heat is transferred through the rear paddle face member to the collapsible container of food product positioned in the storage area of the storage enclosure.

9. The device of claim 8 wherein the heating element is a resistance wire heating element coupled to a supply of electricity to generate heat.

10. The device of claim 8 wherein the pressure paddle extends between an upper end and a lower end and includes an opening formed therebetween, the opening positioned to permit a fitting contained in the collapsible container of food product positioned in the dispensing area to pass through the pressure paddle as the food product is dispensed.

11. The device of claim 10 wherein the pressure paddle includes an upper section and a lower section, the lower section extending from the upper section at an angle such that the lower section of the pressure paddle is generally parallel to a front wall of the storage enclosure when the pressure paddle is pivoted toward the front wall of the storage enclosure.

12. The device of claim 7 wherein the storage enclosure includes a pair of opposed sidewalls, a front wall and a back wall that are joined to define the open interior, the storage area being at least partially defined by the pressure paddle and the back wall, the dispensing area being at least partially defined by the pressure paddle and the front wall.

13. The device of claim 12 wherein the pressure paddle is pivotally mounted between the pair of opposed sidewalls.

14. A device for heating and dispensing food product contained within a collapsible container, comprising:

a storage enclosure sized to receive at least two collapsible containers of food product, the storage enclosure having an open interior defined by a pair of sidewalls, a front wall and an end wall;

a heating element positioned adjacent to each of the walls defining the open interior of the storage enclosure;

a movable pressure paddle positioned to divide the open interior of the storage enclosure into a dispensing area and a storage area, both the dispensing area and the storage area receiving at least one collapsible container of food product; and a pump assembly operatively positioned to dispense food product from the collapsible container of food product positioned in the dispensing area of the storage enclosure;

wherein the collapsible container of food product in the storage area forces the pressure paddle into contact with the collapsible container of food product in the dispensing area to urge the food product toward the pump assembly.

15. The device of claim 14 wherein the pressure paddle is pivotally mounted between the pair of opposed sidewalls and is movable toward and away from the front wall of the storage enclosure.

16. The device of claim 15 wherein the pressure paddle extends between an upper end pivotally mounted between the opposed sidewalls and a lower end, the pressure paddle including an opening formed between the upper end and the lower end, the opening positioned to permit a fitting contained in the collapsible container of food product positioned in the dispensing area on to pass through the pressure paddle as the pressure paddle moves toward the front wall.

17. The device of claim 16 wherein the pressure paddle includes an upper section and a lower section, the lower section extending from the upper section at an angle such that the lower section of the pressure paddle is generally parallel to the front wall of the storage enclosure when the pressure paddle is fully pivoted toward the front wall.

18. A device for heating and dispensing food product contained within a collapsible container, comprising:

a storage enclosure sized to receive at least two collapsible containers of food product, the storage enclosure having an open interior defined by a pair of sidewalls, a front wall and an end wall;

a heating element positioned adjacent to each of the walls defining the open interior of the storage enclosure;

a movable pressure paddle positioned to divide the open interior of the storage enclosure into a dispensing area and a storage area, both the dispensing area and the storage area receiving at least one collapsible container of food product, the pressure paddle including a heating element; and a pump assembly operatively positioned to dispense food product from the collapsible container of food product positioned in the dispensing area of the storage enclosure;

wherein the collapsible container of food product in the storage area forces the pressure paddle into contact with the collapsible container of food product in the dispensing area to urge the food product toward the pump assembly.

19. The device of claim 18 wherein the pressure paddle is pivotally mounted between the pair of opposed sidewalls and is movable toward and away from the front wall of the storage enclosure.

20. The device of claim 19 wherein the pressure paddle extends between an upper end pivotally mounted between the opposed sidewalls and a lower end, the pressure paddle including an opening formed between the upper end and the lower end, the opening positioned to permit a fitting contained in the collapsible container of food product positioned in the dispensing area to pass through the pressure paddle as the pressure paddle moves toward the front wall.

21. The device of claim 20 wherein the pressure paddle includes an upper section and a lower section, the lower section extending from the upper section at an angle such that the lower section of the pressure paddle is generally parallel to the front wall of the storage enclosure when the pressure paddle is fully pivoted toward the front wall.

22. The device of claim 18 wherein the pressure paddle includes a front paddle face member and a rear paddle face member, the heating element positioned between the forward paddle face member and the rear paddle face member, the heating element being operable to generate heat that is transferred through the front paddle face member to the collapsible container of food product positioned in the dispensing area and heat is transferred through the rear paddle face member to the collapsible container of food product positioned in the storage area.

23. The device of claim 22 wherein the heating element contained within the pressure paddle is an electric resistance wire heating element.

* * * * *